United States Patent [19]

Christie

[11] Patent Number: 4,858,405

[45] Date of Patent: Aug. 22, 1989

[54] BUILDING SYSTEM FOR WINDOWS, ENCLOSURES, BUILDINGS AND THE LIKE

[76] Inventor: Dawson A. Christie, 629 Beecher Avenue, Winnipeg, Manitoba, Canada, R2P 0G5

[21] Appl. No.: 71,782

[22] Filed: Jul. 10, 1987

[51] Int. Cl.[4] ..... E04C 2/38; E06B 2/26; E06B 3/44

[52] U.S. Cl. ..... 52/208; 52/202; 52/476

[58] Field of Search ..... 52/207, 208, 172, 304, 52/308, 788, 476, 202; 49/485, 496

[56] References Cited

U.S. PATENT DOCUMENTS

| | | | |
|---|---|---|---|
| 2,993,242 | 7/1961 | Leisibach | 52/304 |
| 3,899,858 | 8/1975 | Zanker | 52/172 |
| 4,184,297 | 6/1980 | Casamayor | 52/476 |
| 4,187,642 | 2/1980 | Morinaga et al. | 49/406 |
| 4,248,018 | 2/1981 | Casamayor | 52/202 |

FOREIGN PATENT DOCUMENTS

| | | | |
|---|---|---|---|
| 703215 | 1/1954 | United Kingdom | 52/207 |
| 2147044 | 5/1985 | United Kingdom | 52/788 |

*Primary Examiner*—James L. Ridgill, Jr.
*Attorney, Agent, or Firm*—Irell & Manella

[57] ABSTRACT

A plurality of extrusions are provided including a base extrusion, at least on intermediate extrusion, and a sealing extrusion. These may be precut or cut on site and assembled with panels to form a building structure such as a greenhouse, porches and the like. However, primarily they are designed to form fixed sealed, single, double, triple or sliding window units.

24 Claims, 6 Drawing Sheets

BUILDING SYSTEM FOR WINDOWS, ENCLOSURES, BUILDINGS AND THE LIKE

BACKGROUND OF THE INVENTION

This invention relates to new and useful improvements in building systems including sliding or fixed windows, enclosures, buildings and the like. Conventionally, such systems are manufactured in a shop or factory with relatively expensive machinery and labour being used, with the frames of metal, wood, plastic, or fiberglass, or various combinations of these materials with insert panels of wood, glass, fiberglass panels, or different types of plastic panels.

Due to the high manufacturing costs and complexities of fabrication and installation of all other types of sliding windows and the relative inefficiency with regard to air-tightness, the market is being taken over by more expensive casing and awning type windows.

SUMMARY OF THE INVENTION

The present invention overcomes these disadvantages by providing firstly, a window system which is simple to manufacture, is virtually air tight, can be mounted in a jamb or on a flat, sloped or curving surface. Alternatively, an entire structure can be formed such as a greenhouse, porch enclosure or the like with fixed or sliding panels of various materials either transparent, translucent or opaque. It is designed to be snapped together or taken apart simply and easily and it can be assembled at the location with a few simple tools inasmuch as it consists of several basic extrusions with some modified extrusions for window systems depending upon whether the system is to be assembled within a window jamb frame or on a flat type frame.

In the following description and some of the claims the term "system" includes window assemblies of all types, free standing structures, or enclosures such as greenhouses, storage sheds and the like, attached porches, verandas, enclosures and the like and any form of structure which can be assembled basically by snap-engaging extrusion and fixed or sliding panels.

In accordance with the present invention, there is provided a building system for jamb or flat mounting within a supporting frame and comprising in combination a base extrusion, an intermediate extrusion and a sealing extrusion, means to secure said base extrusion around the supporting frame, said base extrusion supporting a first panel, means on said intermediate extrusion snap-engagable with said base extrusion to hold said first panel in clamping and sealing relationship therebetween, said intermediate extrusion supporting a second panel in a plane spaced from said first panel, and means on said sealing extrusion snap-engaging said intermediate extrusion to hold said second panel in clamping and sealing relationship therebetween.

In accordance with a further advantage of the invention, there is provided a kit for building systems including sliding window assemblies which include a supporting frame, said kit comprising a base extrusion, an intermediate extrusion and a sealing extrusion, means to secure said base extrusion around the supporting frame, said base extrusion supporting a first window panel, means on said intermediate extrusion snap-engagable with said base extrusion to hold said first panel in clamping and sealing relationship therebetween, said intermediate extrusion supporting a second window panel in a plane spaced from said first window panel, and means on said sealing extrusion snap-engaging said intermediate extrusion to hold said second window panel in clamping and sealing relationship therebetween.

In accordance with a still further advantage of the invention, there is provided a method for forming a building assembly such as a window assembly in a flat or jamb mounting environment and within a supporting frame, consisting of the steps of cutting a base extrusion to fit around said frame, securing said base extrusion to said frame, placing a first panel in position upon part of said base extrusion, cutting an intermediate extrusion to fit around said frame and snap-engaging said intermediate extrusion with said base extrusion thereby holding said first panel therebetween in sealing relationship, placing a second panel upon said intermediate extrusion and cutting a sealing extrusion to fit around said frame and snap-engaging said sealing extrusion to said intermediate extrusion thereby holding said second panel in sealing relationship therebetween.

In accordance with a still further advantage of the invention, there is provided a system, kit and method of forming a sliding window assembly which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 12 is an end view of an extrusion for assembling a wall panel or the like.

In the drawings like characters of reference indicate corresponding parts in the different figures.

DETAILED DESCRIPTION

Figure 5:
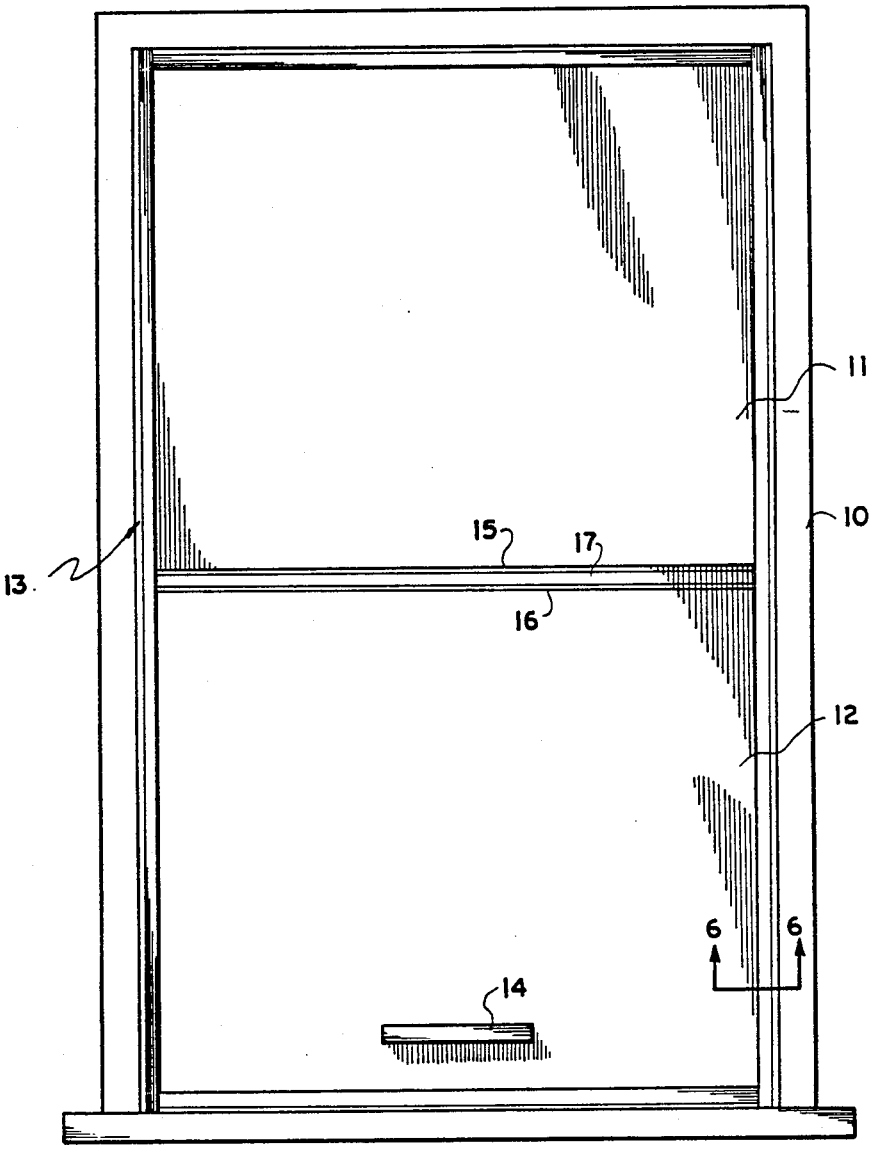
FIG. 5 is a front elevation showing a sliding window assembly utilizing the present system.
Figure 5A:
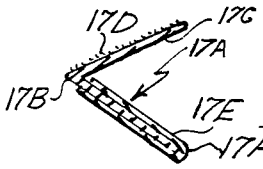
FIG. 5A is an enlarged cross sectional view of the preferred sealing strip between the sliding panes such as shown in FIGS. 5 and 16.

Proceeding therefore to describe the invention in detail, reference should first be made to FIG. 5 which shows a window frame 10 having a fixed or sliding window panel or light 11 therein which may be formed from glass or clear plastic, or may be a solid panel, opaque or transparent, and a sliding window panel or light or panel 12 which also may be formed of glass or clear plastic etc., slideable vertically within the plastic extrusions collectively designated 13. These panels may, of course, slide horizontally if desired. It will be appreciated that the term "panel" includes fixed or moveable window lights, and panels of all materials, including transparent, translucent or opaque panels, screens and the like.

A handle portion 14 is secured centrally of the window panel 12 adjacent the lower end thereof and it will be noted that when the movable window panel 12 is in the lowermost position, the upper edge 15 thereof overlaps the lower edge 16 at the upper or fixed panel. A flexible and resilient sealing strip 17 is secured to the upper panel and is situated between the upper and lower panels intermediate the over-lapping portions thereof as clearly shown.

Figure 16:
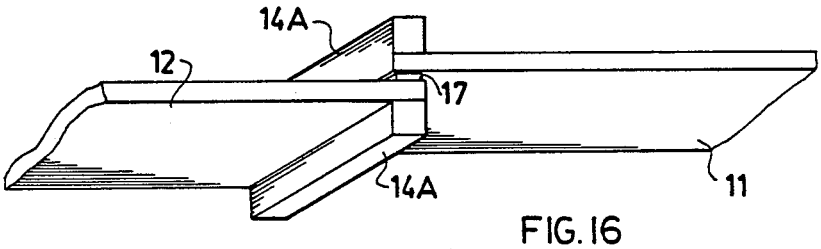
FIG. 16 shows an isometric view of the preferred embodiment of the operating handles which also act as stiffening bars on plastic panels.

FIG. 16 shows an embodiment used with plastic panels in which the handles 14A extend across the panels adjacent the meeting line and also act as stiffeners to reduce deflection of the panels which may lead to air or moisture leakage therebetween.

In both instances, the flexible and resilient sealing strip 17A is preferably formed with a V-shaped cross sectional configuration similar to the adhesive weather seal manufactured by 3M Mfg. Co. of Minnesota. This is a semi-rigid plastic strip with a longitudinal crease 17B formed along the longitudinal axis so that, in use, the strip can be folded into the V-configuration with the crease forming a living hinge and the resiliency of the material normally urging the two halves apart. The outer face of one half 17C is provided with adhesive 17D and the strip is secured to one of the panels, preferably the fixed panel, at the overlap with the free half 17E engaging the other panel, preferably the sliding panel.

Because this material is naturally flexible longitudinally as well as the outward pressure formed by the living hinge, provides an excellent seal which follows any slight deflections of the panels caused by the pressure thereof of the channels in which the panels run. However this material does tend to scratch the sliding panel, particularly if it is made from plastic and in order to prevent this, the free half is covered by a strip of material 17F such as a non-woven textile strip of polyester fibres thermally bonded together and sold under the Trade Mark "PELLON". This is folded over the free edge of the free half 17E of the V-shaped V-strip and secured to both sides by adhesive.

FIGS. 1 through 4 and 6 through 14, show details of the various extrusions which make up the system.

Figure 2:
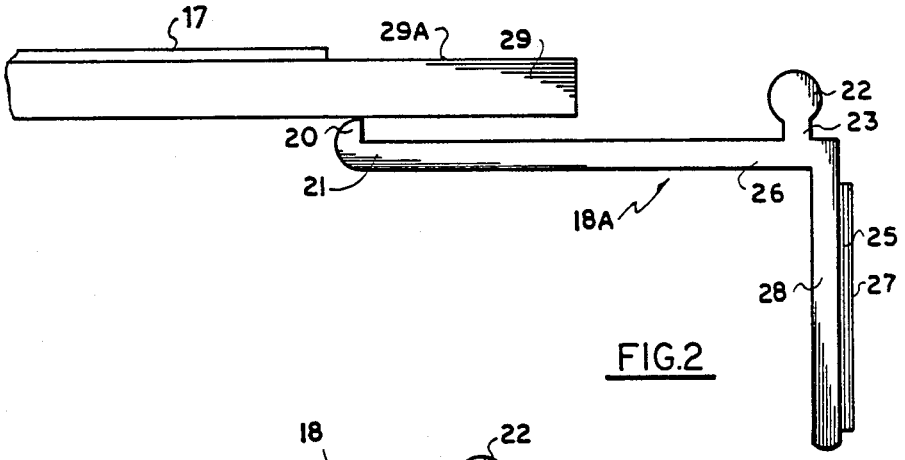
FIG. 2 is a modification of FIG. 1 adapted for securement to a window jamb frame or building system frame.
Figure 1:
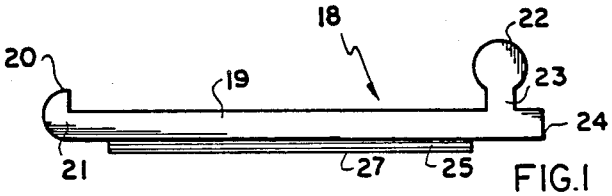
FIG. 1 is an end view of the base extrusion used on a flat frame system.

FIGS. 1 and 2 show the base extrusion collectively designated 18 and 18A respectively, extrusion 18 being designed for use upon a flat frame, or building member and extrusion 18A being designed for use within a window jamb system or similar building structure.

The base extrusion 18 includes a planar flange 19 having an upturned panel engaging lip 20 formed along one edge 21 thereof and extending the full length of the extrusion.

A rounded bead 22 is formed on the edge of an upwardly extending strip 23 spaced slightly inboard from the other edge 24 of the planar portion and this also extends the full length of the extrusion. This bead 22 extends upwardly on the same side of the planar portion as does the lip 20.

Figure 6:
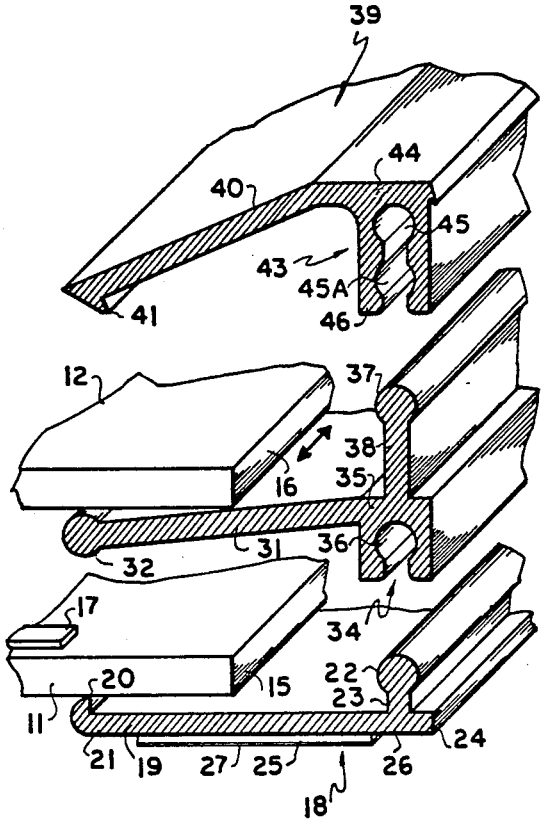
FIG. 6 is an isometric cross sectional view along the line 6—6 of FIG. 5 but showing the parts exploded.

Reference to FIG. 6 will show means to secure this base extrusion to a flat, curved or sloping frame support taking the form of a strip of two-way tape 25 adhesively secured to the planar portion on the side 26 opposite to the lip 20 and the bead 22. The conventional protective strip 27 remains in place until it is desired to attach the base extrusion to the frame or member. Alternatively attachment may be by way of staples, adhesives or the like.

Figure 7:
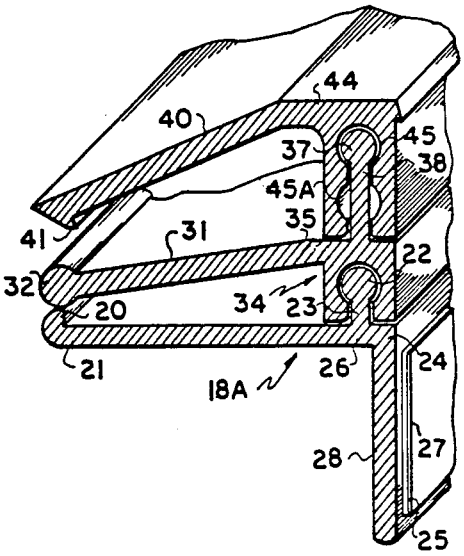
FIG. 7 is a view similar to FIG. 6 but showing the parts assembled but with the panels removed for clarity.

FIG. 7 shows the alternative embodiment 18A which includes a downwardly extending flange 28 extending perpendicularly from the planar portion from the edge 24 and upon the opposite side to the lip 20 and bead 22. A strip of two-way tape 25 is secured to the outer face of this flange 28 with the protective strip 27 remaining in place until it is desired to secure same to a frame or member, as mentioned previously, other attachment means may be utilized. Under normal conditions, the frame is transported snapped together in sets and upon arrival at the building site, it is cut to size, and assembled and installed.

When installing the system, the base extrusion is cut to size either mitered or square cut at the corners, and is adhesively (or otherwise) secured to the flat frame, building member or window jamb on all four sides by the removal of the relevant protective layer 27 from the two-faced or two-way tape thus forming a perimetrical base for the assembly.

A half size fixed or moveable window panel 29 is then placed over half of the window if a sliding window assembly is required or over the entire base frame if a fixed double glazed type window is required and this first window panel 29 rests upon the lip 20 as clearly shown in FIG. 2.

An intermediate extrusion is next provided collectively designed 30 and this includes a central planar portion 31 having a sealing bead 32 formed on one edge 33 thereof and extending the full length of the extrusion.

A bead engaging clamp portion collectively designated 34 extends downwardly from the other edge 35 of the central planar portion in the form of a pair of resilient jaws defining a bead aperture 36 and a sealing member engaging bead 37 is formed on the upper edge of a strip 38 which extends from the central planar portion on the side opposite to the clamp portion 34. It will be noted that the transverse axis of the central planar portion is inclined downwardly with regard to the vertical axis of the bead 37 and clamp portion 36, the purpose of which will hereinafter be described.

This intermediate portion is cut to the required length either square cut or miter cut and the individual portions are snap-engaged by the clamp portion 36, upon the bead 22 of the base extrusion so that the under side of the bead 32 of the intermediate portion is forced into contact upon the upper surface 29A of the first light 11, it being understood that the material forming from the extrusions is resilient so that the central planar portion 31 will deflect due to the pressure of bead 32 upon the light 11 or 29 thus sealing the panel in position between bead 32 and bead 20 and maintaining the relatively air tight environment.

A sealing extrusion is next provided collectively designed 39 and this includes a downwardly inclining, panel engaging planar flange 40 having a downturned sealing lip 41 extending along one edge 42 thereof.

A double bead engaging clamp portion collectively designed 43 extends downwardly from the other edge 44 thereof and is provided with two bead engaging apertures 45 and 45A defined by the pair of resilient jaws 46.

A second window panel 12 is positioned upon the upper side of bead 32 of the intermediate extrusions and the sealing extrusions 39 are cut to size with either a square or miter cut as desired and snap-engaged over the bead 37 of the intermediate portion thus forcing the lip 41 of the sealing extrusion, into contact with the upper surface 47 of the panel 12 and in turn pressing this panel into sealing engagement with the upper side of bead 32 of the intermediate portion.

This second panel may also extend over the full area of the window if a double glazed non-sliding assembly is required or over the other half of the frame with the edges over-lapping as shown and described in FIG. 5.

With the bead 37 engaging the bead aperture 45A, of the sealing extrusion, the window panel 12 may slide between bead 32 and lip 41. If however it is desired to increase the sealing relationship around this second panel 12 then the sealing strips are pressed downwardly thus deflecting the planar flange 40 even more until the aperture 45 snap-engages the bead 37 of the intermediate extrusions. This effectively prevents or makes more difficult the sliding action but at the same time increases the sealing relationship. If relatively large windows are required, then thicker material may be used for the panels.

In all cases, the seal 17 between panels 11 and 12 is always maintained regardless of the position of the sliding panel 12 regardless of whether one or both of the panels are moveable.

It will therefore be seen that long lengths of the extrusions may be carried and cut to size on site and the windows installed and constructed with the minimum of tools and the minimum of effort.

Although the drawings and the majority of the description refers to window assemblies, nevertheless, as mentioned previously, the system can be adapted for use with free standing buildings such as greenhouses, storage sheds or the like and enclosures over porches or porch or patio extensions which utilizes the extrusions for frames with the various windows, panels or screens being placed as desired, said panels being manufactured from various planar materials such as glass, plastic or wall board, metal or composition panels, the glass or plastic ones of which may be transparent, translucent or opaque. Furthermore screen materials can also be used within a metal or plastic frame and be snap-engaged in position.

FIGS. 8 through 14 show various extrusions which can be utilized for these purposes as well as for the assembly of windows and the like.

Figure 8:
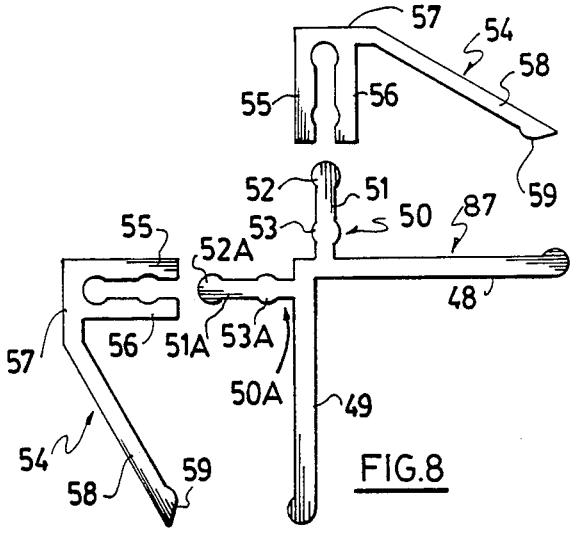
FIG. 8 is an exploded end view of the extrusions useable in a corner construction.

In FIG. 8, a corner extrusion is provided collectively designated 87 including a planar flange 48 and a vertical flange at right angles illustrated at 49. If made of metal for example, this can be a vertical corner support for an enclosure or building.

It is provided with a first bead portion 50 including a flange 51 and a pair of longitudinally extending beads 52 and 53 formed as clearly illustrated. This portion 50 extends perpendicular from the horizontal flange 48. A similar flange 50A having similar characteristics extends perpendicular from the other flange 49 and at right angles to the flange 50.

Both of these portions 50 and 50A receive in snap-engagement relationship, upper or panel sealing extrusions collectively designated 54 which are similar in configuration one with the other.

They include a pair of bead engaging jaws 55 and 56 in spaced and parallel relationship with one another and formed from a resilient material so that they will snap-engage over beads 52 and/or 53. These jaws extend from the main wall portion 57 from which extends a panel engaging flange 58 outwardly and downwardly as clearly illustrated. This flange 58 is also resilient and terminates in a panel engaging bead 59 operating similar to the member illustrated in FIG. 4.

If the member 47 is situated vertically, then vertical wall or window panels can be erected at right angles to one another and held in position by the members 54 which are cut to the required length and snap-engaged as hereinbefore described.

Figure 9:
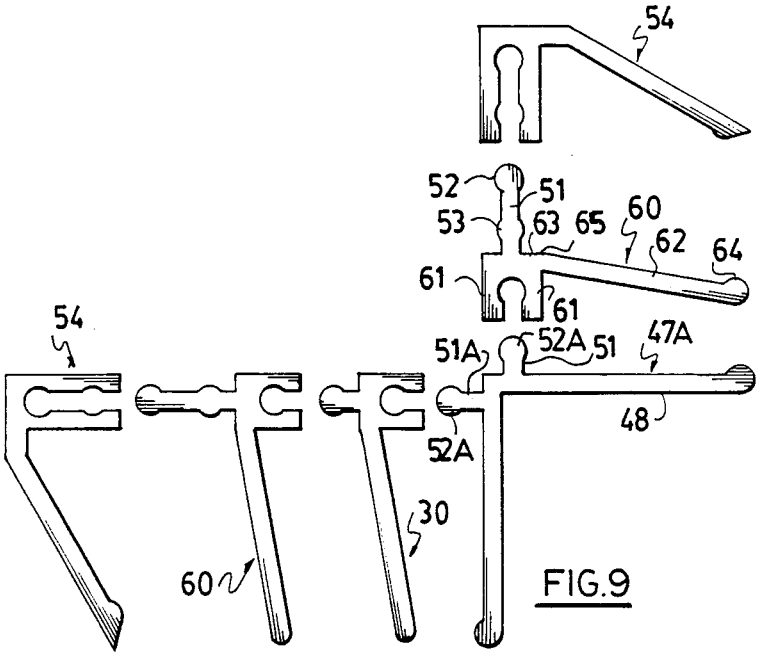
FIG. 9 is a view similar to FIG. 8 but showing additional extrusions.

FIG. 9 shows a similar corner component 47A with the exception that only one longitudinally extending bead 52A is shown upon flanges 51 and 51A.

Two alternative constructions are shown in FIG. 9. Firstly an intermediate extrusion collectively designated 60 is provided having jaws 61 snap-engage over bead 52A and a panel engaging flange 62 extends outwardly and downwardly therefrom to clamp a panel between flange 62 and the horizontal flange 48.

A sealing extrusion 54 as hereinbefore described snap-engages over either or both of beads 52 or 53 formed on flange 51 extending up from the 63 of the intermediate flange which is similar to the corresponding portion 50 shown in FIG. 8 and the sealing flange operates in a manner similar to that hereinbefore described.

It should be observed that the distal end 64 of flange 62 is built up substantially level with the surface 65 of the portion 63 and this stiffens the end of the flange and prevents this distal end from bowing towards the centre thereof due to the pressure of the sealing extrusion 54, when engaged over the portion 51 of the intermediate flange.

An intermediate flange similar to that illustrated in FIG. 3 and indicated generally by reference character 30 may engage over either of the beads 52A of the extrusion 47A followed by a further intermediate flange similar to that illustrated by reference character 60 once again terminating with a sealing flange 54 as shown. It will of course be appreciated that many of these parts can be interchanged depending upon design and the panels to be clamped and sealed between adjacent extrusions.

Once again this may form a vertical corner to an enclosure and may have solid, opaque or transparent panels as desired. Either the construction of FIG. 8 or FIG. 9 may be used for example in a horizontal location in a vertical wall and a flat roof portion.

Figure 11:
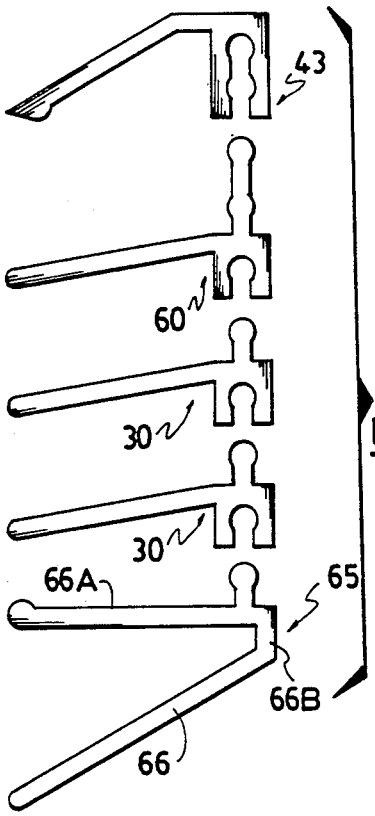
FIG. 11 is an exploded end view of a plurality of extrusions for three panels and a panel such as a screen and showing a base moulding suitable for use on a sloping thermopane (TRADEMARK) moulding.
Figure 10:
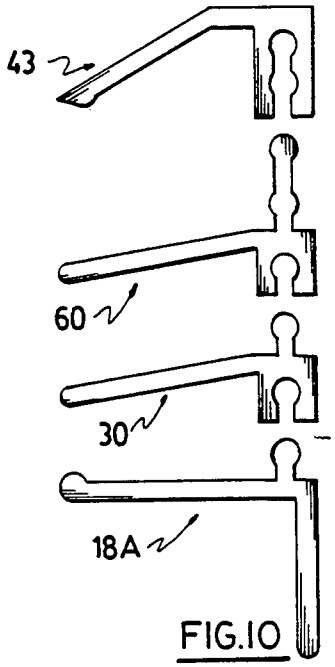
FIG. 10 is an exploded end elevation of the extrusions for two panels and a third panel such as a screen.

FIGS. 10 and 11 show various combinations of the snap-engageable extrusions with the base extrusion of FIG. 10 being similar to extrusion 18A of FIG. 2.

Figure 4:
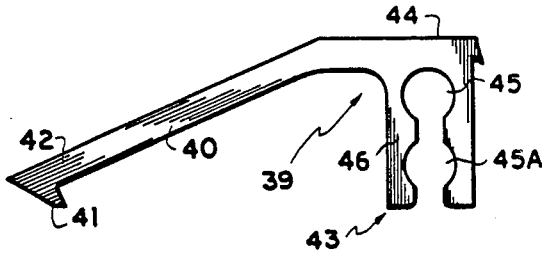
FIG. 4 is an end elevation of the sealing extrusion.

This may be provided with an intermediate extrusion assembly 30 followed by a further intermediate extrusion 60 and a sealing extrusion 43 illustrated in FIG. 4.

Figure 10A:
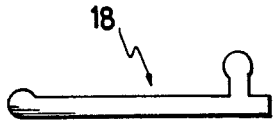
FIG. 10A is an end elevation of an extrusion similar to the base extrusion of FIG. 10.

FIG. 10A shows an alternative base extrusion similar to 18 illustrated in FIG. 1.

In FIG. 11, the base extrusion collectively designated 65 includes a base flange 66 which inclines outwardly and downwardly from flange 66B. This is so that it can be mounted on a tapered molding such as often used with a Thermopane (trademark) construction.

Once again this may be snap-engaged by intermediate extrusions such as 30 and 60 and surmounted by a sealing extrusion 43.

These two constructions shown in FIGS. 10 and 11 may receive fixed and or sliding panels either double or triple and may be surmounted by a screen held in place by the sealing extrusions 43 with the adjustable relationship therebetween being controlled by the double bead and socket or groove configuration depending upon the thickness of the frame used for the screen.

Once again many combinations can be utilized depending upon design parameters and whether the designs are for window lights or panels and screen assemblies or whether they are for fixed full or partial wall panels.

Figure 12:
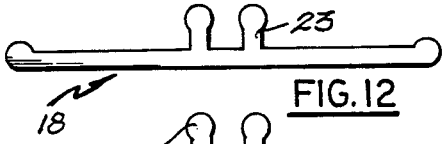
Figure 13:
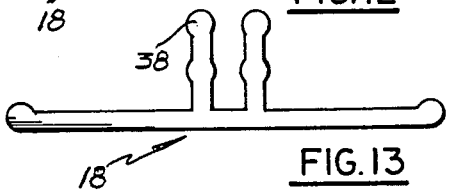
FIG. 13 is a view similar to FIG. 12 but showing a double bead configuration for adjustment purposes.
Figure 14:
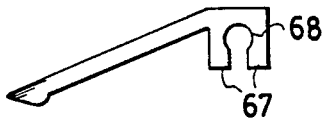
FIG. 14 is a view similar to FIG. 4 but showing a single bead engaging recess.

FIGS. 12 and 13 show base extrusions which can be used with various sealing extrusions to hold panels in a vertical or horizontal position and FIG. 14 shows a sealing extrusion similar to that illustrated in FIG. 4 but having a pair of jaws 67 defining a single bead engaging recess 68.

Figure 15:
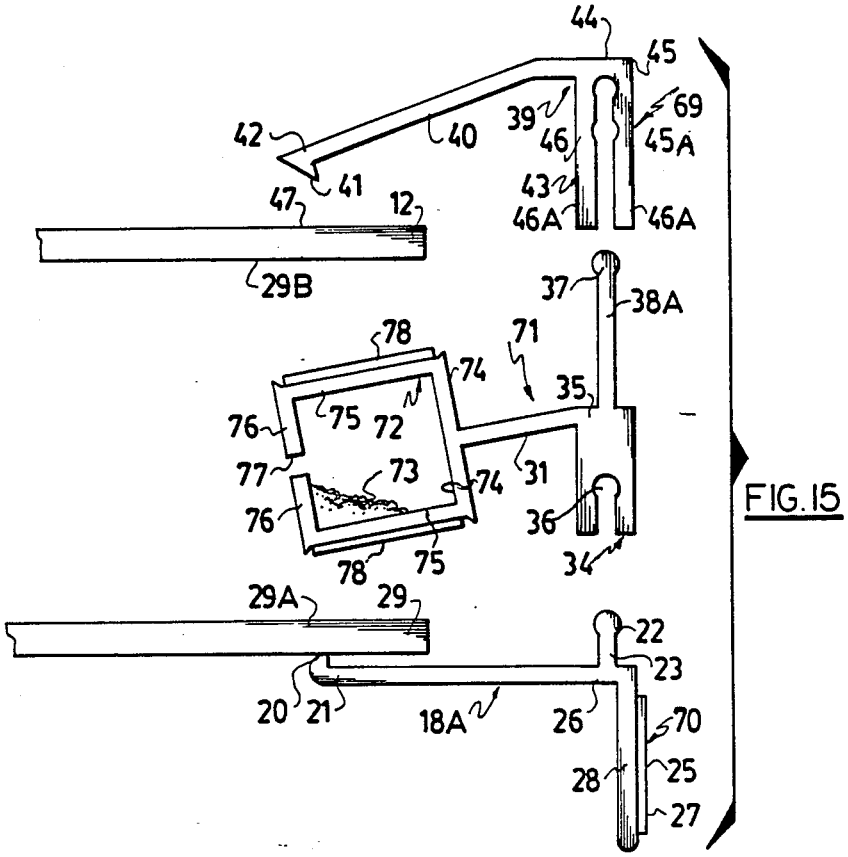
FIG. 15 is an exploded end view of a double glazed sealed window assembly.

FIG. 15 shows a modification which is particularly suitable for use as a sealed unit window assembly which once again can be made up on site.

Reference character 69 shows a modified FIG. 4 with the exception that the legs or resilient jaws 46 are extended beyond the bead engaging aperture 45A as indicated by reference character 46A. This extrusion is the sealing extrusion for the sealed window assembly.

Reference character 70 shows the base extrusion similar to FIG. 2 with the glass or panel 29 engaged therewith.

Figure 3:
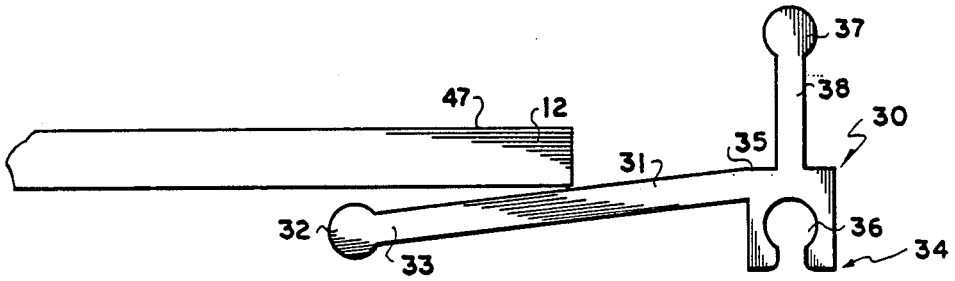
FIG. 3 is an end elevation of the intermediate extrusion.

The intermediate extrusion collectively designated 71 is somewhat similar to the intermediate extrusion of FIG. 3 with the exception that in stead of the bead 32 on the distal end 33 of the central planar portion 31, there is provided an elongated, rectangular cross-sectioned hollow portion collectively designated 72 which is designed to hold dessicant indicated by reference character 73. This dessicant holder includes the offstanding inner walls 74, one upon each side of the flange of strip 31, spaced and parallel upper and lower walls 75 extending therefrom and outer walls 76 extending from the edges of the upper and lower wall 75 with these inner walls terminating spaced apart as indicated at 77 or, alternatively, being provided with drillings therethrough.

Double faced sealing tapes 78 are provided upon the upper and lower walls 75 and engage the upper surface 29A of the window panel 29 and the lower surface 29B of the window panel 12 respectively when the components are assembled and snap-engaged one with the other, it being understood that the intermediate extrusion 71 is snap-engaged with the base extrusion 70 with the window panel 29 in place and the sealing extrusion 69 is then snap-engaged with the intermediate extrusion 71 with the window panel 12 clamped therebetween.

This forms a double glazed sealed window unit with dessicant 73 being provided in order to prevent any condensation from forming therebetween.

It will also be noted that the flange 38A of the intermediate extrusion is longer than the flange 38 shown in FIG. 3 and that the jaws 36 are spaced further from the strip 31 than shown in FIG. 3 to allow for the dessicant holder 72.

In all cases it should be appreciated that the end views of the moldings or extrusions shown can be manufactured from metal, plastic or pultruded in fiberglass and can have resilient characteristics sufficient to provide the necessary detachable engagement one with the other and to give the necessary sealing relationship between the extrusions and the panels detachably held thereby.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A building system for jamb or flat mounting within a supporting frame and comprising in combination a base extrusion, at least one intermediate extrusion, a sealing extrusion and a snap-fitting means connecting sections of the extrusions onto framing strips extending along each side of the supporting frame, the base extrusion including a substantially planar flange, a lip projecting from an outer side of the flange, along a free first edge thereof; the intermediate extrusion including a substantially planar flange, a sealing bead along a free first edge of the flange and projecting to opposite inner and outer sides thereof; the sealing extrusion including a substantially planar flange, a lip along a free first edge of the flange and projecting to an inner side thereof; and the snap-fitting means extending along opposite second edges of the base, intermediate and sealing extrusions, and connecting the intermediate extrusions between the outer side of the base extrusion and the inner side of the sealing extrusion, with the planar flanges of the extrusions converging towards their free first edges;

the base extrusion, the intermediate extrusion and the sealing extrusion being connected solely by the snap-fitting means whereby the free first edges of the extrusions are unconnected for receiving a first window pane between the planar flanges of the base extrusion and the intermediate extrusion, with the lip of the base extrusion and the bead of the intermediate extrusion engaging opposite sides of the first window pane, and for receiving a second window pane between the planar flanges of the intermediate extrusion and the sealing extrusion with the bead of the intermediate extrusion and the lip of sealing extrusion in engagement with opposite sides of the second window pane.

2. A building system according to claim 1 including a first panel supported within said frame, with edge portions thereof engaged between the lip of the base extrusion and the bead of the intermediate extrusion and a second panel supported within said frame, with edge portions thereof engaged between the lip of the sealing extrusion and the bead of the intermediate extrusion.

3. The system according to claim 2 in which said intermediate extrusion includes a bead engaging clamp portion extending along the second edge of said planar flange on the inner side thereof, said clamp portion being snap-engaged by said base extrusion, and a sealing extrusion engaging bead extending along said second edge of said planar flange on the outer side thereof to said bead engaging clamp portion, for snap-engagement with said sealing extrusion.

4. The system according to claim 2 which includes a dessicant holder on the first edge of said intermediate extrusion and sealing strips on inner and outer side of said dessicant holder, said base extrusion, said first panel, said intermediate extrusion, said second panel and said sealing extrusion being snap engaged together in sealing relationship to form a sealed unit window assembly.

5. The invention according to claim 4 in which said second panel is in sliding relationship between said intermediate extrusion and said sealing extrusion.

6. The system according to claim 2 in which said base extrusion includes a bead extending along a second edge of said planar flange, on the outer side thereof, said bead snap-engaging with said intermediate extrusion.

7. The system according to claim 6 in which said intermediate extrusion includes a bead engaging clamp portion extending along the second edge of said planar flange on the inner side thereof, said clamp portion being snap-engaged by said base extrusion, and a sealing extrusion engaging bead extending along said second edge of said planar flange on the outer side thereof to said bead engaging clamp portion, for snap-engagement with said sealing extrusion.

8. The system according to claim 6 including means to secure said base extrusion around the supporting frame including a length of two-way tape on an inner side of said planar flange.

9. The system according to claim 8 in which said intermediate extrusion includes a bead engaging clamp portion extending along the second edge of said planar flange on the inner side thereof, said clamp portion being snap-engaged by said base extrusion, and a sealing extrusion engaging bead extending along said second edge of said planar flange on the outer side thereof to said bead engaging clamp portion, for snap-engagement with said sealing extrusion.

10. The system according to claim 2 wherein each of the first and second panels has a free edge, and including stiffeners along the free edge of said panels and a sealing strip along the free edge of one of said panels between said first and second panels.

11. The system according to claim 10 in which said intermediate extrusion includes a bead engaging clamp portion extending along the second edge of said planar flange on the inner side thereof, said clamp portion being snap-engaged by said base extrusion, and a sealing extrusion engaging bead extending along said second edge of said planar flange on the outer side thereof to said bead engaging clamp portion, for snap-engagement with said sealing extrusion.

12. The system according to claim 10 in which said sealing strip comprises an elongated, resilient strip of semi-rigid synthetic plastic, creased along the longitudinal center line to form a living hinge, thus forming a V-shaped cross sectional configuration when installed, said strip adhesively secured to one of said panels, and an anti-friction surface provided over the other or free half of said V-shaped strip adapted to eliminate scratching of the panel sliding thereagainst.

13. The system according to claim 2 in which said second panel is slideable between said sealing extrusion and said intermediate extrusion.

14. The system according to claim 13 in which said base extrusion includes a bead extending along a second edge of said planar flange, on the outer side thereof, said bead snap-engaging with said intermediate extrusion.

15. The system according to claim 13 in which said intermediate extrusion includes a bead engaging clamp portion extending along the second edge of said planar flange on the inner side thereof, said clamp portion being snap-engaged by said base extrusion, and a sealing extrusion engaging bead extending along said second edge of said planar flange on the outer side thereof to said bead engaging clamp portion, for snap-engagement with said sealing extrusion.

16. The system according to claim 13 wherein the first panel has a free edge, and including a sealing strip along the free edge of said first panel between said first and second panels.

17. The system according to claim 16 in which said sealing strip comprises an elongated, resilient strip of semi-rigid synthetic plastic, creased along the longitudinal center line to form a living hinge, thus forming a V-shaped cross sectional configuration when installed, said strip adhesively secured to one of said panels, and an anti-friction surface provided over the other or free half of said V-shaped strip adapted to eliminate scratching of the panel sliding thereagainst.

18. The system according to claim 2 including means to secure said base extrusion to said frame including a jamb engaging flange extending from a second edge of said planar flange on the inner side thereof, and perpendicular to said planar flange, and a length of two-way tape on an outer face of said jamb engaging flange.

19. The system according to claim 18 in which said intermediate extrusion includes a bead engaging clamp portion extending along the second edge of said planar flange on the inner side thereof, said clamp portion being snap-engaged by said base extrusion, and a sealing extrusion engaging bead extending along said second edge of said planar flange on the outer side thereof to said bead engaging clamp portion, for snap-engagement with said sealing extrusion.

20. The system according to claim 19 in which said sealing extrusion includes a double bead engaging clamp portion projecting from the inner side of the planar flange, along the second edge thereof, and being selectively snap-engagable with said intermediate portion.

21. A framing strip for a multi-track window comprising:

a base extrusion including a substantially planar flange and a lip projecting from an outer side of the flange, along a free first edge thereof;

an intermediate extrusion including a substantially planar flange and a sealing bead along a free first edge of the flange and projecting to opposite inner and outer sides thereof;

a sealing extrusion including a substantially planar flange, a lip projecting from an inner side of the flange, along a free first edge thereof;

snap-fitting means along opposite second edges of the base, intermediate and sealing extrusions connecting the intermediate extrusion between the outer side of the base extrusion and the inner side of the sealing extrusion, and with the planar flanges of the extrusions converging towards their free first edges; and the base extrusion, the intermediate extrusion and the sealing extrusion being connected solely by the snap-fitting means whereby the free first edges of the extrusions are unconnected for receiving a first window pane between the planar flanges of the base extrusion and the intermediate extrusion, with the lip of the base extrusion and the bead of the intermediate extrusion engaging opposite sides of the first window pane, and for receiving a second window pane between the planar flanges of the intermediate extrusion and the sealing extrusion with the bead of the intermediate extrusion and the lip of sealing extrusion in engagement with opposite sides of the second window pane.

22. A framing strip according to claim 21 wherein the base extrusion includes a snap-fitting bead projecting from the outer side of the flange, along an opposite second edge thereof.

23. A framing strip according to claim 22 wherein the intermediate extrusion includes a snap-fitting groove on an inner side of the flange and a snap-fitting bead on an opposite outer side of the flange, both along a second edge of the flange, the groove being engaged on the snap-fitting bead of the base extrusion.

24. A framing strip according to claim 23 wherein the sealing extrusion includes a snap-fitting groove on the inner side of the flange, along an opposite second edge thereof, the groove being engaged with the snap-fitting bead of the intermediate extrusion.

* * * * *